US010900217B2

(12) United States Patent
Fransen

(10) Patent No.: US 10,900,217 B2
(45) Date of Patent: Jan. 26, 2021

(54) BUILDING SPACE DIVIDER SYSTEM

(71) Applicant: ZIPPERWALL HOLDING B.V., Weesp (NL)

(72) Inventor: Johannes Antonius Sasja Fransen, Weesp (NL)

(73) Assignee: ZIPPERWALL HOLDING B.V., Weesp (NL)

( * ) Notice: Subject to any disclaimer, the term of this patent is extended or adjusted under 35 U.S.C. 154(b) by 135 days.

(21) Appl. No.: 15/768,806

(22) PCT Filed: Oct. 14, 2016

(86) PCT No.: PCT/NL2016/050710

§ 371 (c)(1),
(2) Date: Apr. 16, 2018

(87) PCT Pub. No.: WO2017/065612

PCT Pub. Date: Apr. 20, 2017

(65) Prior Publication Data

US 2019/0338511 A1 Nov. 7, 2019

(30) Foreign Application Priority Data

Oct. 15, 2015 (NL) ..... 2015625

(51) Int. Cl.
*E04H 12/00* (2006.01)
*E04B 1/343* (2006.01)
(Continued)

(52) U.S. Cl.
CPC ..... *E04B 1/34321* (2013.01); *E04B 1/34384* (2013.01); *E04B 2/7433* (2013.01); *E04H 1/125* (2013.01)

(58) Field of Classification Search
CPC .. E04H 1/125; E04H 1/00; E04H 3/00; E04B 2/7433; E04B 2/7854; E04B 2002/7446;
(Continued)

(56) References Cited

U.S. PATENT DOCUMENTS 3,499,251 A 3/1970 Sandmann et al.
4,137,683 A 2/1979 Pfeiffer
(Continued)

FOREIGN PATENT DOCUMENTS

CN 1523174 A 8/2004
GB 2396364 A 6/2004

*Primary Examiner* — Chi Q Nguyen
(74) *Attorney, Agent, or Firm* — AEON Law, PLLC; Adam L. K. Philipp; David V. H. Cohen

(57) ABSTRACT

A building space divider system for providing one or more rooms in a building space, the building space divider system comprising at least two framework beams and coupling strips, in which the framework beams extend in a longitudinal direction, and the framework beams include longitudinal beam coupling parts where two of the framework beams are back-to-back coupled via the coupling strips, each coupling strip comprising two strip parts each having a beam coupling end extending along a longitudinal side of the strip part for coupling to the beam coupling part of the framework beam, and a strip coupling end extending along an opposite longitudinal side of the strip part.

6 Claims, 8 Drawing Sheets

(51) Int. Cl.
*E04B 2/74* (2006.01)
*E04H 1/12* (2006.01)

(58) Field of Classification Search
CPC ..... E04B 2/82; E04B 2/7424; E04B 1/348; E04B 1/34321; E04B 2002/7461; E04B 1/34384; E04B 2002/7466; E04B 2/7425
USPC ..... 52/653.1, 126.4, 242, 281, 234, 481.1, 52/482
See application file for complete search history.

(56) References Cited

U.S. PATENT DOCUMENTS 4,344,475 A 8/1982 Frey
6,253,449 B1 * 7/2001 Chen ..... B25B 7/02 29/751
6,389,772 B2 * 5/2002 Gleckman ..... E04C 3/005 52/582.1
6,397,551 B1 * 6/2002 Lewcock ..... E04B 2/766 52/655.1
6,493,996 B1 * 12/2002 Alexander ..... E04B 1/34823 52/234
6,925,761 B1 * 8/2005 De La Marche ... E04B 1/34815 52/220.1
2006/0053701 A1 * 3/2006 Loesch ..... E02D 27/01 52/79.1
2007/0193142 A1 * 8/2007 Franceschet ..... E04B 2/90 52/234
2013/0036702 A1 * 2/2013 Pacetti ..... E04H 1/1205 52/653.2
2014/0102021 A1 * 4/2014 Gosling ..... E04B 2/745 52/234
2014/0115985 A1 5/2014 Hayashi
2015/0047280 A1 * 2/2015 Staten ..... E04B 2/7455 52/281
2015/0345126 A1 * 12/2015 Ryan ..... E04C 2/54 52/11
2017/0121961 A1 * 5/2017 Hodson ..... E04H 1/005
2019/0376276 A1 * 12/2019 Lucho Do Valle ... E04B 1/3442

* cited by examiner

BUILDING SPACE DIVIDER SYSTEM

FIELD OF THE INVENTION

The invention relates to a building space divider system.

BACKGROUND OF THE INVENTION

In the art, many different types of separation wall systems are known. Roughly, there are separation wall systems that provide a temporary barrier, providing for instance screens that can be removed easily. Examples of these systems are for instance provided in U.S. Pat. No. 7,971,622, 8,857,496, US2014/0075851, US2014/0115985 and FR2706752. Usually, these system are light weight and designed for easy mounting and removal. Often, these wall systems are used for instance in display booths, often the walls do not extend up to a ceiling.

Other separation wall systems are more permanent, and usually provided separation walls that run between a floor and a ceiling. These separation wall systems in most cases in this way separate a space in a building into rooms. These separation wall systems usually comprises various posts or beams that provide a frame. Usually, there are floor beams attached to a floor, ceiling beams attached to a ceiling, and standing beams mounted between and connecting the floor beams and the ceiling beams. Furthermore, these separation wall systems comprise wall elements or wall panels attached to these beams. Examples of these separation wall systems are shown in U.S. Pat. No. 7,451,577, EP2180105 and EP2246495.

These last separation wall systems are more permanent and requires tooling and time to install.

U.S. Pat. No. 3,499,251 according to its abstract describes "a room or cabin space partitioning system particularly adapted for fitting out ship's cabins comprising a skeleton framework of identically shaped profiled members having wing parts onto which spring-grip clipping members provided on wall and ceiling panels are mountable, being retained by ledging means on the wing parts to retain said mounted wall and ceiling panels on said profiled members, the like profiled members being prefabricated and connected together as by spot welding to form the skeleton framework, the profile members additionally having generally dove-tail shaped channels intermediate the wing parts in which channel dove-tail portions of cover rails or skirting boards may be engaged."

US2014115985, referred to above already, according to its abstract describes "a convenient and portable space partitioning device comprises a partitioning frame, having an upper frame member, a lower frame member, and two side frame members joined between the upper frame member and the lower frame member, and a hallow space being provided between the upper frame member and the lower frame member. A partitioning cover body, covering an outer surface of the partitioning frame member, is easily removed from the partitioning frame member, while the partitioning cover body and the partitioning frame member are stored conveniently. Moreover, the partitioning cover body has a zipper on both edges of the partitioning frame member, the zipper having a sliding fastener on at least one edge of the partitioning frame member, and the partitioning cover body being bonded to another one of the adjacent partitioning cover body by the zipper and the sliding fastener."

U.S. Pat. No. 4,344,475 according to its abstract describes an "office partition interconnector assembly comprising a separate and independent generally rigid support member fixedly mountable on a lateral end of a partition panel and having edge retaining channel means, e.g. projecting outwardly therefrom and containing an outwardly directed communicating slot, and conjointly therewith a generally resilient flexible web having an enlarged edge at one side thereof for operative removable insertion in the support member channel means and also having attachment means, such as another such enlarged edge, at the other side thereof for removably attaching the web to another partition panel, thereby to provide an interposed self-contained modular type flexible connection between the panels adjustably at any selective angular relation of the panels to form an office partition, the support member and flexible web preferably being bilateral for interconnecting two partition panels in end to end relation or a plurality of such panels in radially disposed adjacency about a common center point within the confines of the corresponding interconnectors thereat, whereby to provide an almost infinite variety of shapes and layouts for rooms accomplished by so joining office partition panels together in an interchangeable modular manner permitting their ready assembly, disassembly and reassembly as desired."

U.S. Pat. No. 4,137,683 according to its abstract describes a "decorative object comprises a plurality of panels joined by slide fasteners. Surface ornamentation on the assembled panels may be continuous. Preferably, all of the panels are a single ply sheet of a woven fabric such as canvas. The decorative object is secured to support means."

SUMMARY OF THE INVENTION

The invention provides a building space divider system that provides easy transportation, assembling and allows providing a separate room inside a larger building space.

The invention pertains to a building space divider system for providing one or more rooms in a building space, said building space divider system comprising at least two framework beams and coupling strips, wherein said framework beams extend in a longitudinal direction and said framework beams comprising longitudinal beam coupling parts, characterized in that two of said framework beams are back-to-back coupled via said coupling strips, each coupling strip comprising two strip parts each having a beam coupling end extending along a longitudinal side of the strip part for coupling to said beam coupling part of said framework beam, and a strip coupling end extending along an opposite longitudinal side of said strip part.

The coupling strip allows swift and easy erection of rooms in a building space. For instance, in a large hall one or more rooms can be made that have an interior that can be closed off from the further space in the hall. For instance, temperature can be managed separately, air may be conditioned separately inside the room, and for instance the interior can have sound insulation.

In an embodiment, the strip coupling ends comprise parts forming a closure, in particular forming a zipper.

In an embodiment, the building space divider system comprising floor beams, framework beams, ceiling support beams, corner beams, coupling strips and wall panels.

In an embodiment, the framework beam coupling elements comprise two framework beam coupling parts having a tongue with a neck, and wherein said framework beams comprising a longitudinal undercut groove, said tongue fitting in said undercut groove, and having a coupling end for coupling said framework coupling parts together for coupling framework beams together and to corner beams.

In particular, the undercut groove may for instance be formed by two opposite, longitudinally extending, opposing hook elements that together provide an undercut groove.

In an embodiment, the ceiling support beams are framework beams.

In an embodiment, the corner beams having at least two adjacent sides provided with framework beam holding parts and with an undercut groove extending in longitudinal direction.

The invention further relates to a method for building a space divider system for providing one or more rooms in a building space, wherein framework beams are positions back-to-back, a strip part is coupled to one framework beam and another, complementary strip part is coupled to the other framework beam, and the strip coupling ends of the strip parts are coupled for coupling said framework beams.

In an embodiment, the strip parts are coupled to said framework beams, next said framework beams are positioned back-to-back, and next the strip coupling ends are coupled.

The invention further relates to a framework beam, in particular an extrusion beam, more in particular a hollow extrusion beam, said framework beam extending in a longitudinal direction and comprising two substantially parallel, opposite panel abutment walls extending in said longitudinal direction, a coupling end abutment wall in extending in said longitudinal direction and perpendicular to the panel abutment walls, and two undercut grooves extending in longitudinal direction at both sides of the coupling end abutment wall, opening in the direction of the coupling end abutment wall surface, and having its longitudinal opening below a plane defined by the coupling end abutment surface.

In an embodiment, each of said panel abutment walls are connected to said coupling end abutment wall via first coupling walls that has a part that is perpendicular to the panel abutment wall, and a subsequent second coupling wall that has a part that is perpendicular to the coupling end abutment wall, and wherein said undercut groove is provided in said first coupling wall.

The invention further relates to a framework beam coupling assembly comprising at least two framework beams mentioned above, and a coupling strip comprising two strip parts each having a beam coupling end extending along a longitudinal side of the strip part for coupling to said beam coupling part of said framework beam, and a strip coupling end extending along an opposite longitudinal side of said strip part for coupling two framework beams together with their abutment surfaces abutting.

The person skilled in the art will understand the term "substantially" in this application, such as in "substantially encloses" or in "substantially extends up to". The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like if used in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The probe herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device or apparatus claims enumerating several means, several of these means may be embodied by one and the same item of hardware. The mere fact that certain measures are recited in mutually different dependent claims does not indicate that a combination of these measures cannot be used to advantage.

The invention further applies to a probe or parts thereof comprising one or more of the characterising features described in the description and/or shown in the attached drawings. The invention further pertains to a method or process comprising one or more of the characterising features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, showing an embodiment of a construction element, and showing in:

FIGS. 2-12 cross sections as indicated in FIG. 1, in which

FIG. 2 shows a cross section through coupled framework beams with wall panels, as indicated in FIG. 1;

FIG. 3 shows a cross section of a floor beam a framework beam with wall panels, as indicated in FIG. 1;

FIG. 4 shows a cross section showing a framework beam as a ceiling support beam with wall panels and a ceiling beam, as indicated in FIG. 1;

FIG. 5 shows a cross section of a corner beam with framework beams and wall panels, as indicated in FIG. 1;

FIG. 6 shows a cross section at a coupling of an outer wall and an inner wall, showing a T coupling of framework beams with wall panels, as indicated in FIG. 1;

FIG. 7 shows a cross section at a glass part showing the framework beams holding glass panels as wall panels, as indicated in FIG. 1;

FIG. 8 shows a cross section at the glass part of FIG. 7 showing the floor beam holding the glass panel of FIG. 7, the cross section position indicated in FIG. 1;

FIG. 9 shows a cross section of ceiling beam resting on a ceiling support beam as indicated in FIG. 1, and FIG. 10 shows a cross section of a coupling beam.

The drawings are not necessarily on scale.

DESCRIPTION OF PREFERRED EMBODIMENTS

Figure 1:
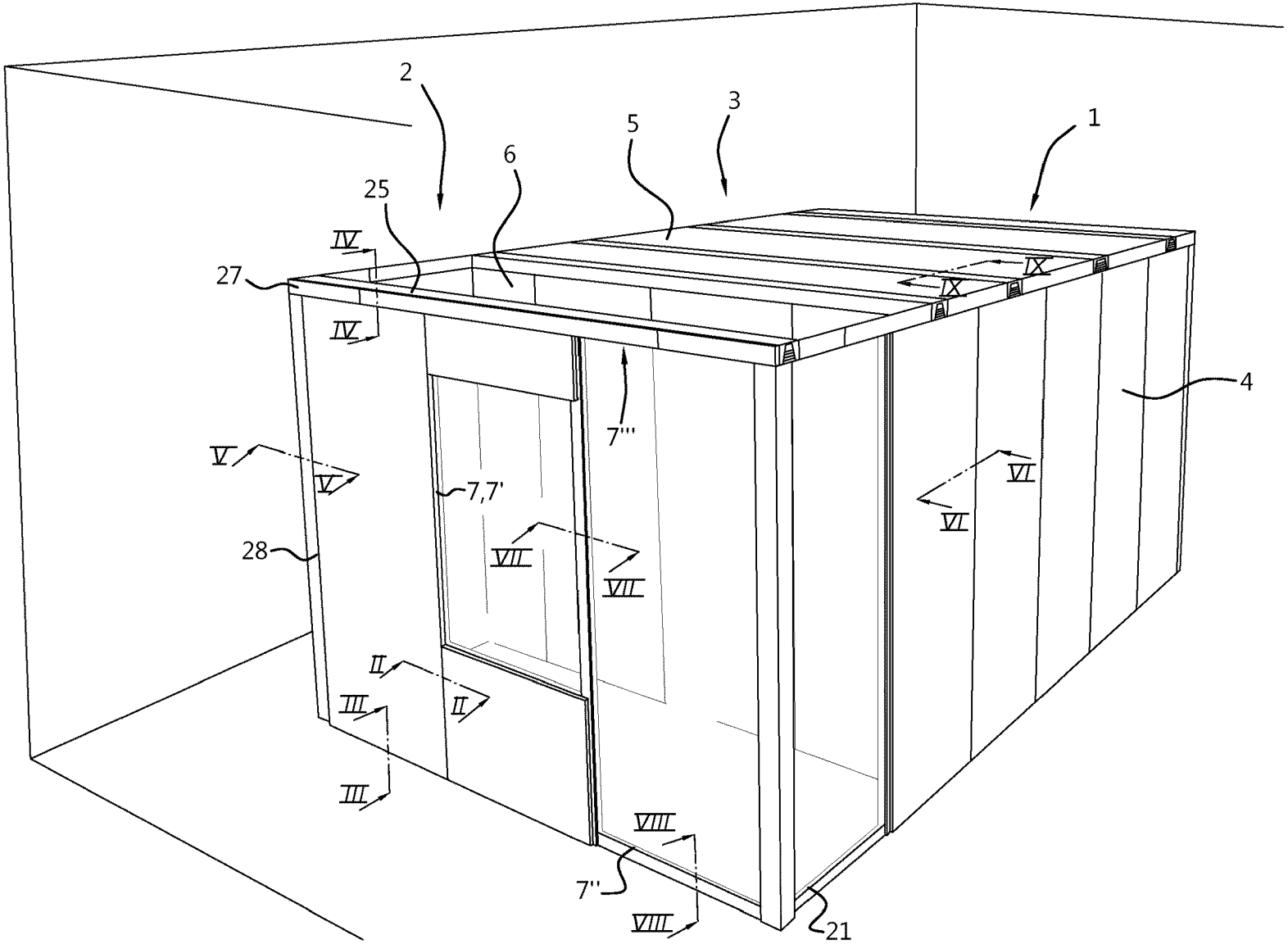
FIG. 1 a perspective view of a space in a building that is provided with a building space divider system so as to provide rooms.

FIG. 1 a perspective view of a space in a building that is provided with a building space divider system 1 so as to provide one or more rooms, here two rooms 2, 3. Using the current building space divider system 1, walls 4 and a ceiling 5 can be created that provide the rooms 2, 3. These rooms 2, 3 can be free standing in the building space, as illustrated in FIG. 1.

In FIGS. 2-12 cross sections as indicated in FIG. 1 are discussed.

Figure 2:
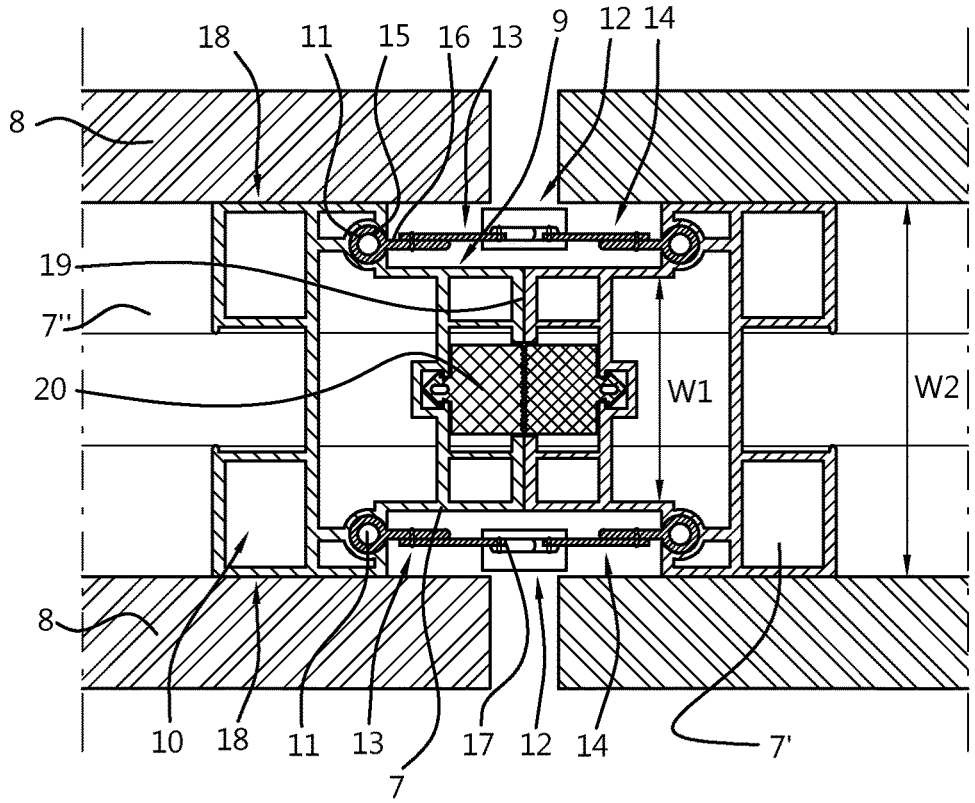

FIG. 2 shows a cross section through coupled framework beams with wall panels, as indicated in FIG. 1. Two framework beams 7, 7' are depicted. These framework beams 7, 7' are placed back-to-back. The framework beams 7, 7' are coupled using coupling strips 12. This keeps the framework beams 7, 7' together with backs 19 against one another.

The framework beams 7, 7' when seen in cross section have a coupling end 9 and a wall panel end 10. The wall panel end has surfaces 18 against which wall panels 8 are attached. The surfaces 18 extend a width W2. The coupling end has a width W1 which is smaller than W2.

There are several ways in which a coupling strip 12 can be attached to a framework beam 7, 7'. Here, the framework beams 7, 7' have longitudinal beam coupling parts 11. These coupling parts allow beam coupling ends 15 of the coupling strip 12 to be attached to the framework beams 7, 7'. Here, the framework beams 7, 7' are provided with rails, here in the form of undercut grooves 11. The coupling strip beam coupling ends 15 are provided with a thickened part 15 that fits in the undercut groove 11. This comprises a neck 16 that extends out of the undercut groove 11. This provides an easy attachment of the coupling strip 12 to be attached to a framework beam 7, 7'. The undercut grooves 11 of the framework beams 7, 7' open towards one another when the framework beams 7, 7' are places back-to-back against one another. Thus, a coupling strip 12 can be formed as a ribbon with beam coupling ends 15 at both opposite sides. This allows strength and a simple design. The framework beams 7, 7' are placed back-to-back with abutting surfaces or coupling end abutment 19. At two opposite sides of the abutting surface, each framework beam 7, 7' has an undercut groove 11.

The coupling strips 12 have in fact two parts 13, 14 that are connected to one another via a releasable connection. Here, each strip part 13, 14 is provided with part of a zipper. Thus, coupling strip parts 13, 14 can be connected by "zipping them up". This provides an easy way of coupling, without use of additional tools. Other releasable connections that may be considered are buttons, hooks and loops, and the like.

In the embodiment, the back sides of the framework beams 7, 7' are provided with resilient profiles 20 that can be snapped onto the framework beams 7, 7'. The resilient profiles extent beyond the back surfaces of the framework beams 7, 7'. In that way, when framework beams 7, 7' are pushed against one another when coupling the framework beams 7, 7' back-to-back, the resilient profiles are pressed onto one another, sealing any remaining space between the coupled framework beams 7, 7'.

Figure 3:
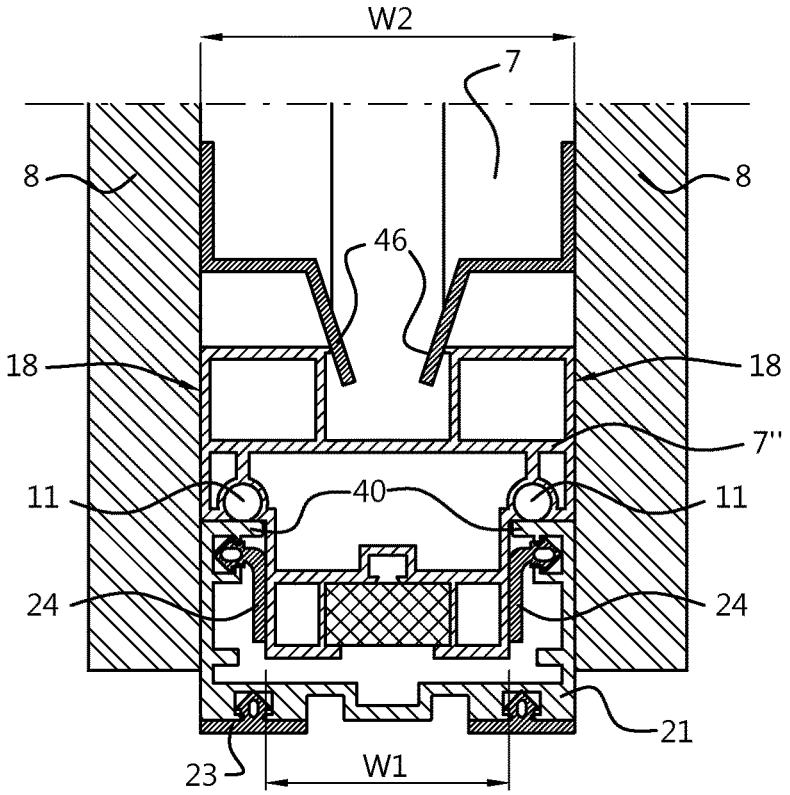

FIG. 3 shows a cross section of a floor beam 21 carrying a framework beam 7" with wall panels 8, as indicated in FIG. 1. Another framework beam 7 is vertical with respect to a floor and here rests on the framework beam 7" that is parallel to a floor and to a floor beam 21. Two sealing profiles 24 seal any remaining space between the framework beam 7" and the floor beam 21. The floor beam 21 rests here on floor damping profiles 23 that are snapped onto the floor beam 21. The floor beam 21 has a longitudinal space that is adapter for receiving a framework beam coupling end 9. The sealing profiles 24 extend in that receiving space.

In FIG. 3, the wall panel 8 is provided with a wall panel lower attachment profile 46. This lower attachment profile 46 hooks behind part of the framework beam 7". It holds the wall panels against the panel abutment 18.

Figure 4:
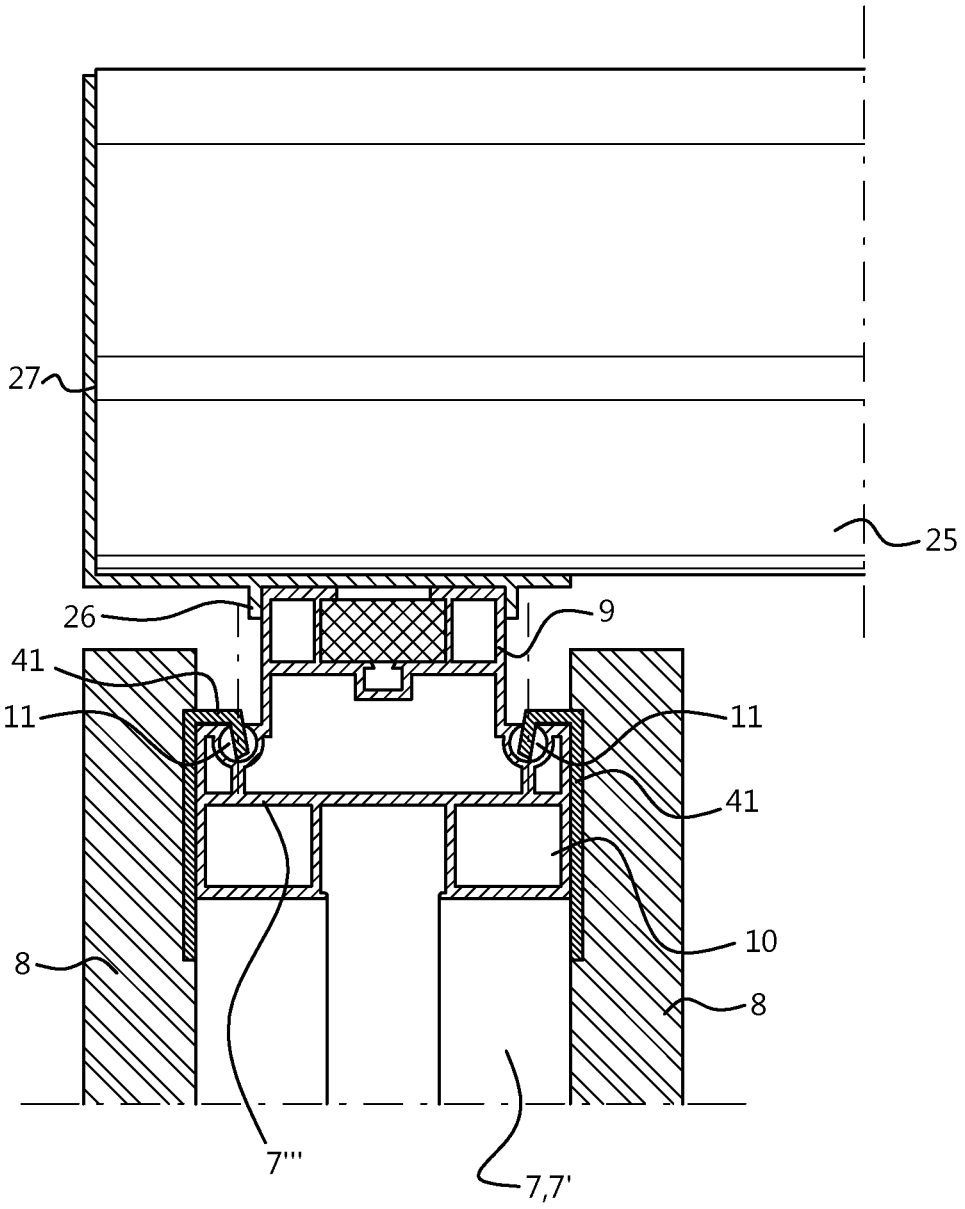

FIG. 4 shows a cross section showing a framework beam 7' as a ceiling support beam with wall panels 8 and a ceiling beam 25, as indicated in FIG. 1. The ceiling beam 25 comprises two abutments 26, here simple rails, that are spaced at a distance W1 and adapted to receive a framework beam coupling end 9. The framework beam 7' rests on framework beams 7, 7' discussed above. The ceiling beam 25 here comprises a facia board 27. In an embodiment, not shown in the drawing, the facia board or profile 27 comprises ends that are attached to one another to extend larger ends. To that end, the fascia boards can be coupled using rails and coupling parts. In an embodiment, in stead of simple rails as shown in FIG. 4, both abutments 26 any comprise rails for holding coupling parts or coupling ends.

Figure 5:
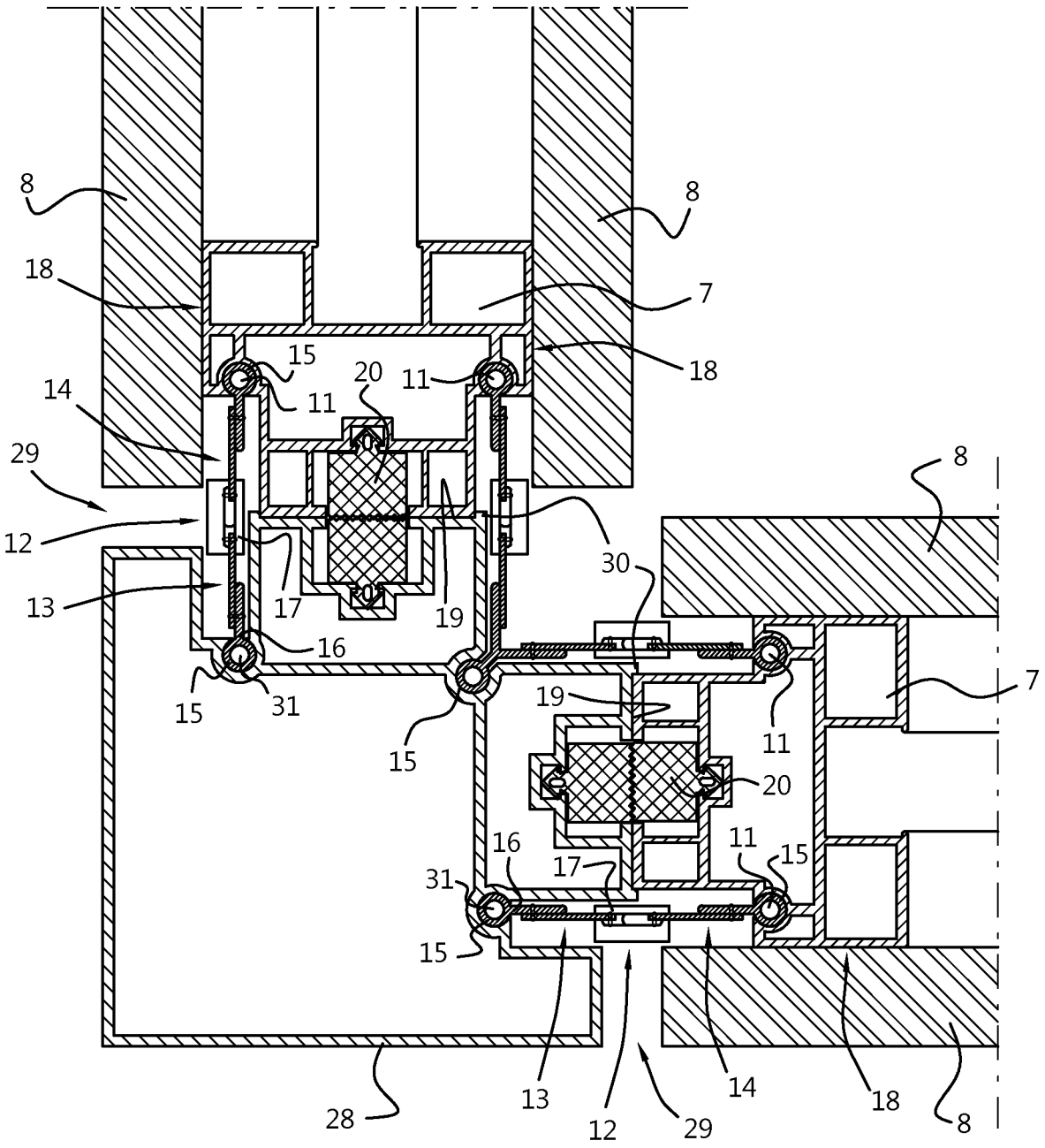

FIG. 5 shows a cross section of a corner beam 28 with two framework beams 7 coupled to it. Wall panels 8 are attached to the framework beams 7. The position of this corner beam 28 is indicated in FIG. 1. The corner beam is provided with beam coupling parts 31 that are identical to the beam coupling parts 11 of the framework beams. This allows to use a coupling strip 12 to couple a framework beam 7 to a corner beam 28 without requiring additional provisions. The framework beams 7 are placed against the corner beam 28 with their backs. The corner beam 28 is provided with abutments 30 for retaining the framework beams 7 from sliding in a direction normal to the longitudinal direction, i.e., from sliding to the left and right or up and down. The abutments 30 are here simple rails 30 at a distance W1 for receiving the coupling ends 9 of the framework beams 7.

Figure 10:
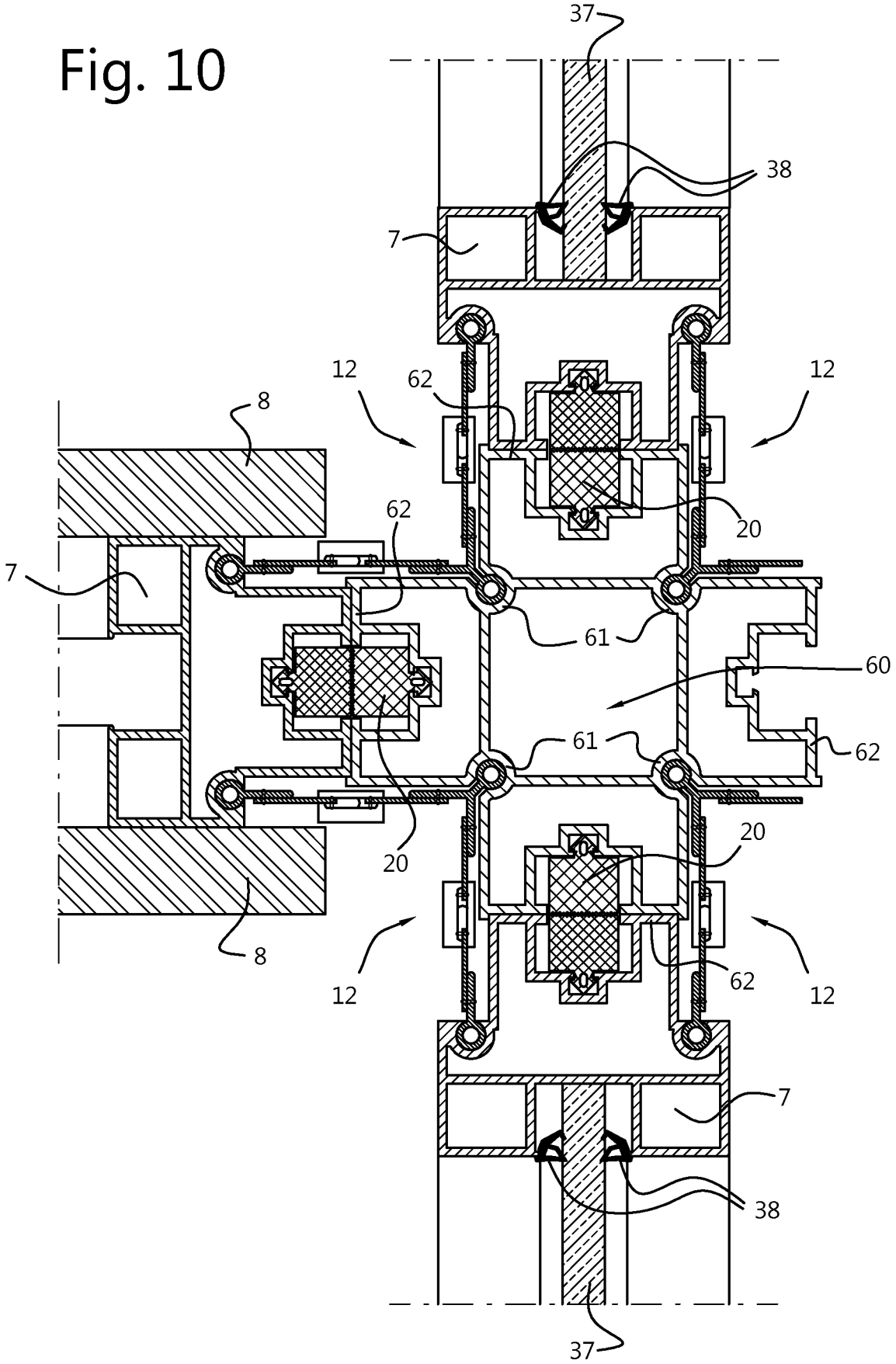

At the corner, the two framework beams 7 are attached to the corner beam 28 using a detail that is further explained when discussing FIG. 10.

At the outside corners, the framework beams are coupled using the already explained coupling strip 12. At the inside corner, an undercut groove 11 is provided. In this inside corner, a special embodiment of the coupling strip 12 is provided. In this embodiment, the coupling strip 12 has two identical strip parts 13 with a tongue that fits in the undercut grooves 11 of the framework beams 7 and that are coupled via a strip part that has a tongue 15 fitting in the undercut groove of the corner beam 28. In this embodiment, the strip parts 13 are coupled to the central strip part via a zipper. Thus, again, the strip parts can be provided in the undercut grooves, and after placement of the framework beams 7, the zippers can be zipped up to coupled the framework beams 7 to the corner beams 7. As insulation, filler blocks 20 are again provided as explained. After coupling of the framework beams 7, the wall panels 8 can be installed.

Figure 6:
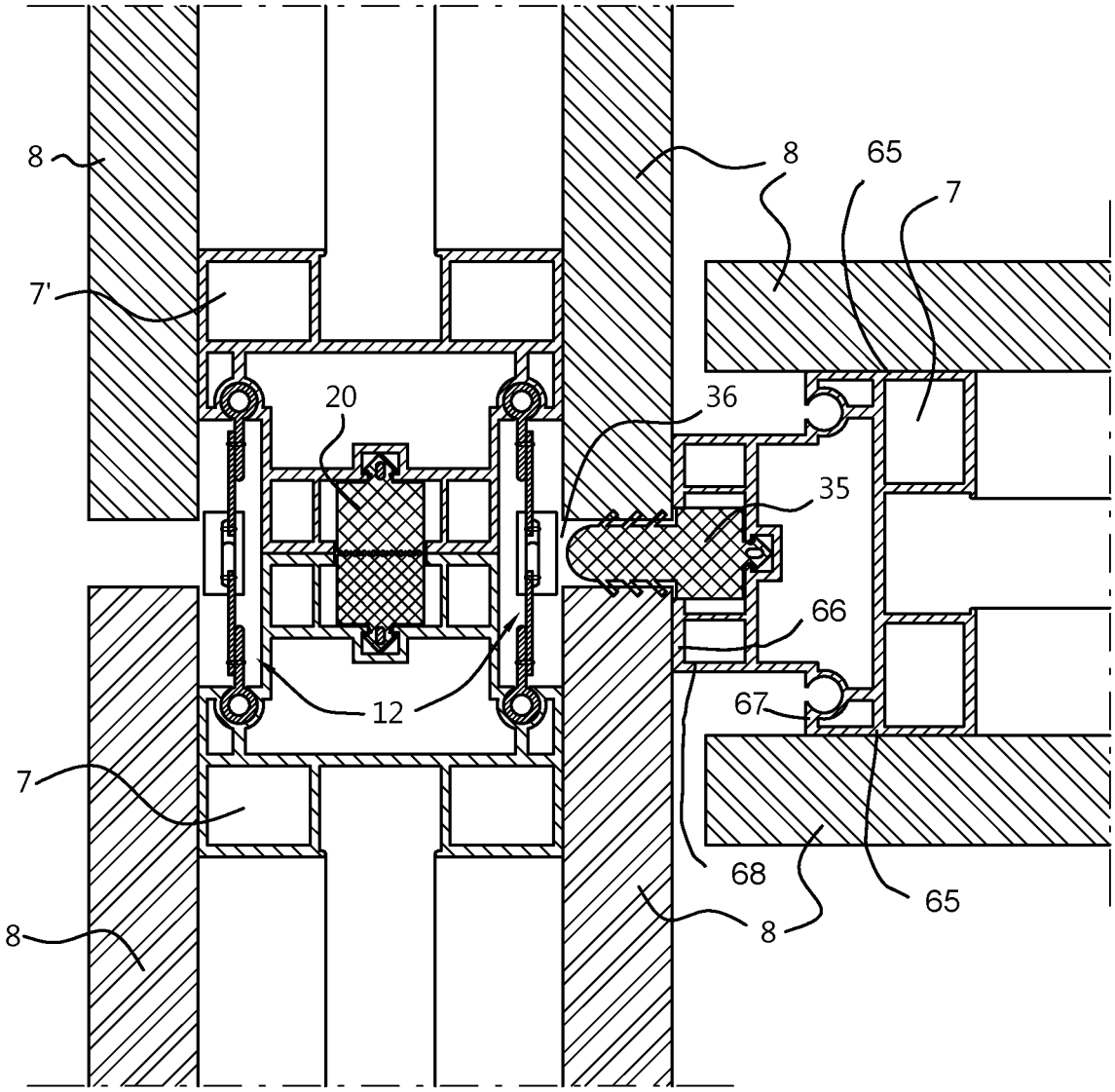

FIG. 6 shows a cross section at a coupling of an outer wall and an inner wall, showing a T coupling of a framework beam 7 with wall panels 8, as indicated in FIG. 1. between two wall panels, a gap or slit 36 remains. Framework beam 7 is here provided with an inner wall coupling part 35. Here, it is a plastic part, in particular an elastomeric part that is flexible enough to be pushed into the slit 36, but stiff enough to remain in the slit 36.

Here, the panel abutment walls 65 that provide the panel abutment are indicated, and the coupling end abutment wall 66. that provide coupling abutment 19 for is similar framework beam are indicated. These walls all to not need to be exactly smooth, but provide an abutment surface that is planar. Also, the first coupling wall 67 and second coupling wall 68 are indicated.

Figure 7:
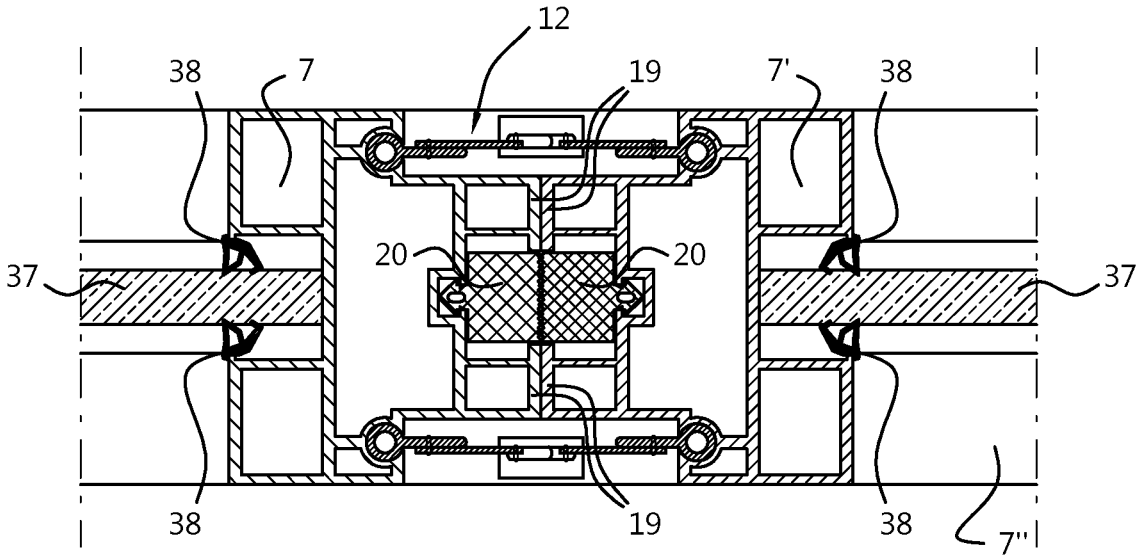

FIG. 7 shows a cross section at a glass part showing the framework beams 7, 7' holding glass panels 37 as wall panels, as indicated in FIG. 1. Here, sealing strips 38 are provided to keep the glass panels 37 in the framework beams 7, 7' in a flexible manner.

Figure 8:
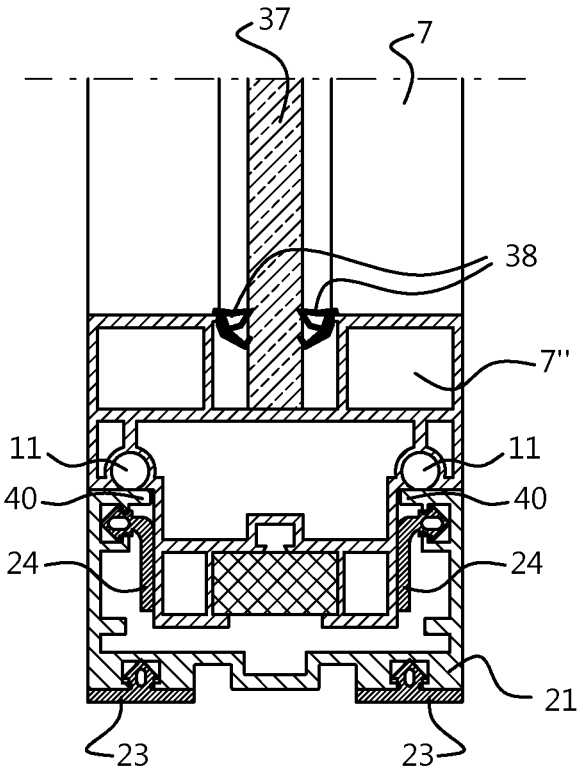

FIG. 8 shows a cross section at the glass part of FIG. 7 showing the floor beam holding the glass panel of FIG. 7, the cross section position indicated in FIG. 1. Again, sealing strips 38 are provided to hold the glass panel 37 in a flexible manner. The sealing strip 7 is usually from an elastomeric material.

Figure 9:
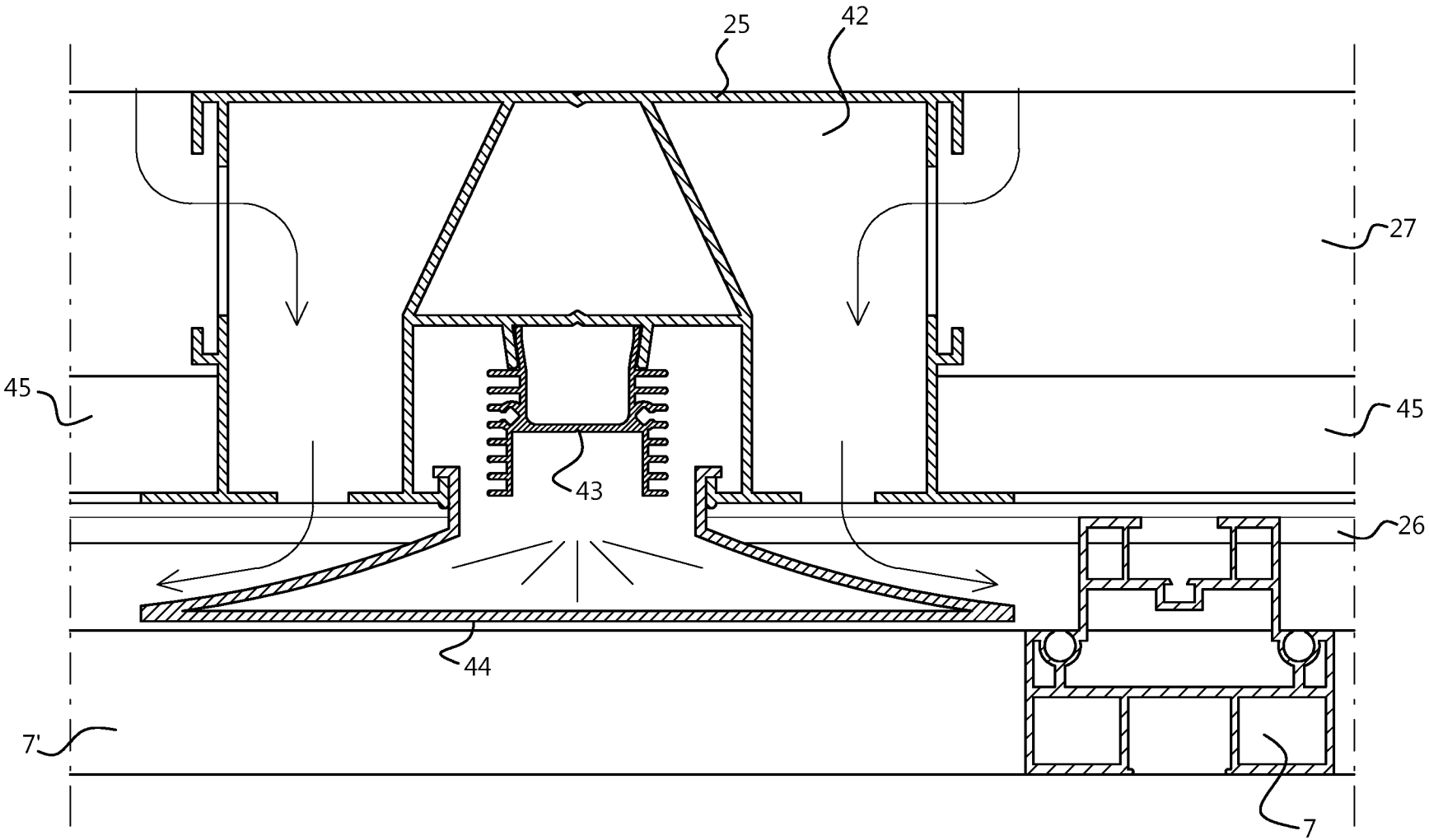

FIG. 9 shows a cross section of ceiling beam 25 resting on a ceiling support beam 7 and a board 27 as indicated in FIG. 1 and FIG. 4.

The ceiling beam 25 has some features to include functionality for air conditioning or ventilation and for illumination of the room. The ceiling beam 25 largely is a beam with a rectangular cross section. It has ventilation channels 42 that extend in longitudinal direction. The arrows at both sides indicate entrance and exit of air. This air can simply be ventilation air, but may also be fully conditioned air. The ceiling beam 25 further comprises a rail for mounting a lighting mount 43. The lighting mount 43 can hold for instance an LED lighting. A lighting element 44 covers the lighting mount 43 and can for instance provide more diffuse light. The lighting element 44 can also extend the ventilation outlet as indicated in the drawing. The lighting element 44 here snaps onto the ceiling beam 25. In an embodiment, the lighting element is a plastic element, for instance of a milky transparency.

The ceiling beam 25 further has rails for holding ceiling panels 45. The ceiling beam 25 can be a metal beam, for instance aluminium, or e polymer beam, for instance fiber-reinforced.

FIG. 10 shows a (vertical) cross beam 60. It can hold four framework beams 7 as shown, allowing making up to four adjacent rooms. The further particulars are also discussed in reference to FIG. 5. The cross beam 60 may also be used as a corner beam when attaching two framework beams 7 perpendicularly and for instance covering the other two cross beam support surfaces 62. In the embodiment, there are four cross beam undercut grooves 61 provided in the corners of the cross beam 60.

It will also be clear that the above description and drawings are included to illustrate some embodiments of the invention, and not to limit the scope of protection. Starting from this disclosure, many more embodiments will be evident to a skilled person. These embodiments are within the scope of protection and the essence of this invention and are obvious combinations of prior art techniques and the disclosure of this patent.

REFERENCE NUMBERS

1 building space divider system
2, 3 rooms
4 wall
5 ceiling
6 room dividing wall
7, 7', 7", 7'" framework beam
8 wall panel
9 framework beam coupling end
10 framework beam panel end
11 Undercut groove
12 coupling strip
13, 14 coupling parts
15 tongue
16 neck
17 coupling means
18 panel abutment
19 coupling end abutment
20 filler block
21 floor beam
22 floor beam floor side
23 floor damping rubber
24 sealing lip
25 ceiling beam
26 ceiling beam framework beam holder
27 board
28 corner beam
29 attachment side
30 framework beam holding part
31 locking part
35 inner wall coupling part
36 inner wall coupling part receiving slit
37 glass panel
38 glass panel sealing strip
40 framework beam support surface
41 wall panel attachment rail/profile
42 ceiling beam ventilation duct
43 ceiling beam lighting mount
44 lighting element
45 ceiling panel
46 wall panel lower attachment profile
50 cross beam
51 cross beam undercut groove
52 cross beam support surface
60 cross beam
61 cross beam undercut groove
62 cross beam support surface
65 panel abutment wall
66 coupling end abutment wall
67 first coupling wall
68 second coupling wall
W1 framework beam coupling end width
W2 framework beam panel end width

The invention claimed is:

1. A building space divider system (1) for providing one or more rooms (2, 3) in a building space, said building space divider system (1) comprising floor beams, at least two framework beams (7, 7', 7", 7'"), ceiling support beams (25), corner beams (28), coupling strips (12) and wall panels (8), said floor beams, framework beams, ceiling support beams, and corner beams forming a room framework, wherein said framework beams (7, 7', 7", 7'") extend in a longitudinal direction, have a cross section having a coupling end (9) having a first width (W1) and an opposite wall panel end (10) having a second width (W2), said second width (W2)

larger than said first width (W1), and said framework beams (7, 7', 7", 7'") comprising longitudinal beam coupling parts (11), wherein two of said framework beams (7, 7', 7", 7'") are back-to-back coupled via said coupling strips (12) that are opposite at both sides of said coupling end with said first width W1, each coupling strip (12) comprising two strip parts (13, 14) each having a beam coupling end extending along a longitudinal side of the strip part (13, 14) for coupling to one of said beam coupling parts (11) of one of said framework beams (7, 7', 7", 7'"), and a strip coupling end extending along an opposite longitudinal side of said strip part (13, 14) for coupling two strip parts (13, 14) together for forming said coupling strip (12), and wherein said strip coupling ends comprise parts forming a closure (17) in form of a zipper.

2. The building space divider system of claim 1, wherein said coupling strips (12) comprise two strip parts (14) having a beam coupling end having a tongue with a neck, and wherein said framework beams comprising a longitudinal undercut groove, said tongue (15) fitting in said undercut groove (11), and having a coupling end for coupling said framework coupling parts together for coupling framework beams together.

3. The building space divider system of claim 1, wherein said framework beams (7, 7', 7", 7'") comprise a longitudinal abutment surface (19) that abut one another when two framework beams (7, 7', 7", 7'") are placed back-to-back, and the framework beam (7, 7', 7", 7'") comprise two undercut grooves (11) running longitudinally along two sides of the abutment surface (19).

4. The building space divider system of claim 1, wherein said ceiling support beams (25) are substantially identical to said framework beams (7, 7', 7", 7'").

5. The building space divider system of claim 1, wherein said corner beams (28) have at least two adjacent sides provided with framework beam holding parts and with an undercut groove extending in longitudinal direction.

6. A method for providing one or more rooms in a building space using the space divider system according to claim 1, wherein one of said strip parts is coupled to one framework beam and another, complementary of said strip parts is coupled to the other framework beam, said framework beams are placed back-to-back, and strip coupling ends of the strip parts are coupled for coupling said framework beams.

* * * * *